United States Patent [19]

Paajanen

[11] 4,209,879

[45] Jul. 1, 1980

[54] CLAMP

[76] Inventor: Erkki Paajanen, 1308 NE. First Ave., Ft. Lauderdale, Fla. 33304

[21] Appl. No.: 918,099

[22] Filed: Jun. 22, 1978

[51] Int. Cl.[2] ..... A44B 21/00

[52] U.S. Cl. ..... 24/248 R; 223/96

[58] Field of Search ..... 24/248 R, 252, 252 B, 24/255 SL; 223/91, 96, 93

[56] References Cited

U.S. PATENT DOCUMENTS

| | | | |
|---|---|---|---|
| 3,020,734 | 2/1962 | Withers | 24/252 R X |
| 3,328,856 | 7/1967 | Jonas | 24/73 GS |
| 3,597,813 | 8/1971 | Takahashi | 24/252 R X |
| 3,744,685 | 7/1973 | Hart | 223/96 |
| 3,823,855 | 7/1974 | Dohring | 223/96 |

*Primary Examiner*—Philip C. Kannan
*Attorney, Agent, or Firm*—Harry N. Schofer

[57] ABSTRACT

A clamp, particularly adapted for use with a clothes hanger, has only two parts or jaws, one jaw of which may be integral with the clothes supporting branch of the hanger. One part of the jaw of the clamp has a pair of closely spaced, transversely extending, members forming a space therebetween, at least one of said members having resilient characteristics as is found in certain plastics, such as Nylon. The clamping end of said jaw includes a resilient loop. The other jaw consists of a curved elongated arm having a slotted pivot means on one end, and a head on the other end. The opposite side of the pivot means carries an indexing means. The slotted pivot means engages one of said transversely extending members forming a pivot for the arm, and the indexing means engage and ride along the other of said transversely extending members, giving the pivoted arm a step-by-step snap action motion when rotated about the pivot. The head is adapted to pass through the loop when the arm is in its closed position, whereby an article to be gripped, for example a garment, is engaged between the head and the loop and held tightly.

10 Claims, 6 Drawing Figures

CLAMP

BACKGROUND OF THE INVENTION

1. Field of the Invention

This invention relates to clamps, and more particularly to a gripping device especially useful for, although not limited to, application on the opposite ends of a clothes hanger to grip a garment, such as a pair of slacks and the like. Hangers of this type, having a center hook, adapted to engage a rod, and a pair of oppositely extending branches having gripping means on the ends, are in common use by clothiers and in the home, as well as by clothes cleaners. The branches support coats, dresses, blouses, shirts and the like, some having recesses to engage shoulder straps on dresses to prevent the dresses from slipping off the hanger, while the end clamps or gripping means suspend slacks, pants, shorts, etc. These are manufactured and used by the millions.

2. Description of the Prior Art

Most prior art devices are made from a number of parts, many of which require metal springs and the like to retain the jaws of the clamp in gripping position. Others have hooked elements to grip the articles being supported, increasing the danger of tearing the supported article when forcibly and accidentally being removed. They are difficult and time consuming to manipulate.

Another device attempts to make the two jaws integral, depending upon the resilience of the material from which the hanger is made to grip and retain the article of clothing. In such devices, however, it is difficult to insert the article of clothing between the jaws, requiring that the end of the clothes hanger be held with one hand while the article of clothing is forced between the jaws. This device is not readily adapted to receive and retain different thicknesses of garments, and involves, in the removal of a garment, the rubbing of the garment against the resilient action of the clamp, with possible damage to the garment.

SUMMARY OF THE INVENTION

It is an object of this invention to provide a novel clamp with a minimum number of parts which is capable of securely gripping articles of different thickness.

It is a further object of this invention to provide a novel clamp in which one jaw can be manufactured integrally with the hanger, as by a process of injection molding, while the other jaw, which can also be manufactured by injection molding, can quickly and easily be inserted in operating position.

It is a still further object to provide a novel clamp in which the movable jaw, consisting of a pivoted arm, can be tightly held in a number of different operating positions and which can readily be operated to any such position by pressure of one's finger or thumb, either to a locking or unlocking position.

It is a still further object to provide a novel clamp which utilizes the inherent resiliency of the material from which it is made to grip an article between the jaws thereof.

It is a still further object to provide a novel clamp which can be manufactured cheaply, and because of its simplicity, is foolproof in operation and has a long and useful life.

The attainment of the above objects, including other useful objects and advantages, is realized by a novel construction of a clamp or gripping device consisting of only two parts which cooperate to form a pivoting means and an article gripping means. While the description herein discloses the clamp on the ends of a clothes hanger for the purpose of gripping articles of clothing and the like, it is obvious that the clamp could advantageously be used for gripping any flexible articles as well as rigid or nonflexible articles.

In a preferred embodiment, described herein, the invention consists of a pair of cooperating elements termed "jaws", one end of one jaw cooperating with one end of another jaw to form a pivot and the other end of said one jaw forming a resilient means to engage and grip an article of clothing and the like. One end of one of the jaws carries a pair of spaced, transversely extending, members forming a space therebetween, and the other end carries a resilient loop supported at one end. The entire clamp could be made from a material having resilient characteristics, such as is found in nearly all plastics, and particularly Nylon. The surface of one end of the other member or jaw includes pivot means, and an opposed surface has indexing means. The opposite end includes a head which passes through the loop when the clamp is in closed position. The pivot means end of the said other jaw is passed through the space mentioned above, engaging one of said transverse members forming a pivot, and the indexing means ride along the other of said transverse members. One or both of said space forming members should have resilient characteristics.

It will be obvious, from the above, that rotation of said other jaw about its pivot will produce a step-by-step motion as the indexing means ride along the transverse member and coming to rest in the dwell between two high points, and that the corrugations forming the indexing means, in cooperation with the resilient action of the transverse members, will produce a snap action to the movement of the jaw and will resiliently retain the jaw against movement from any of its positions. This will provide any degree of opening of the jaws to insert an article to be gripped between the two jaws, and when the said other jaw is in its closed position, the head of the said other jaw will force the article being gripped through the resilient loop to grip the article therebetween. The resiliency of the loop plus the camming action on the indexing means will produce a gripping action holding any article being gripped. The article is easily and quickly released by pressing, with one's finger or thumb, the article gripped through the loop and against the head of the said other jaw, which overcomes the camming action of the indexing means and separates the gripping ends of the jaws.

BRIEF DESCRIPTION OF THE DRAWINGS

For a clearer understanding of the invention and its mode of operation, reference is made to the detailed description of preferred embodiments which follows, and to the annexed drawings, in which.

DETAILED DESCRIPTION OF PREFERRED EMBODIMENTS

Figure 1:
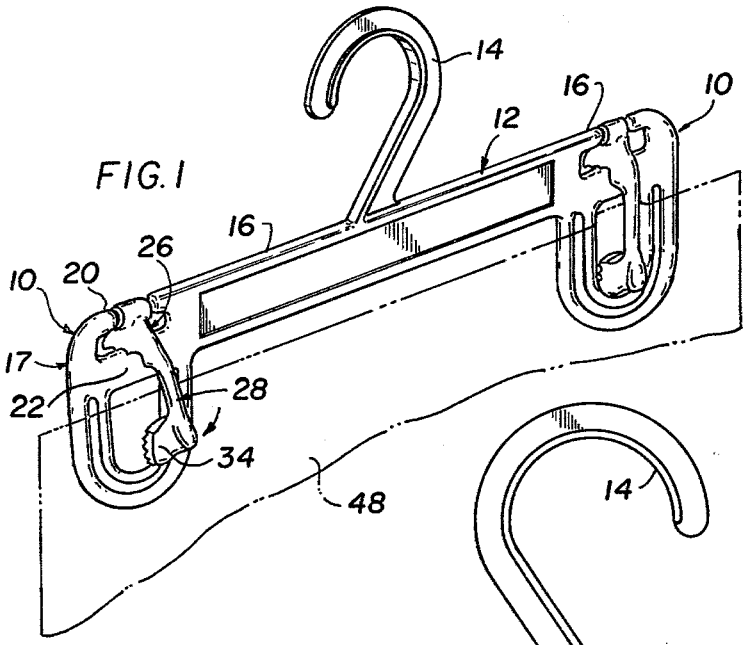
FIG. 1 is a perspective view of the front of one form of the invention, showing a pair of clamps on opposite ends of a clothes hanger, the left hand clamp being shown partially open and the right hand clamp closed or in its gripping position.
Figure 2:
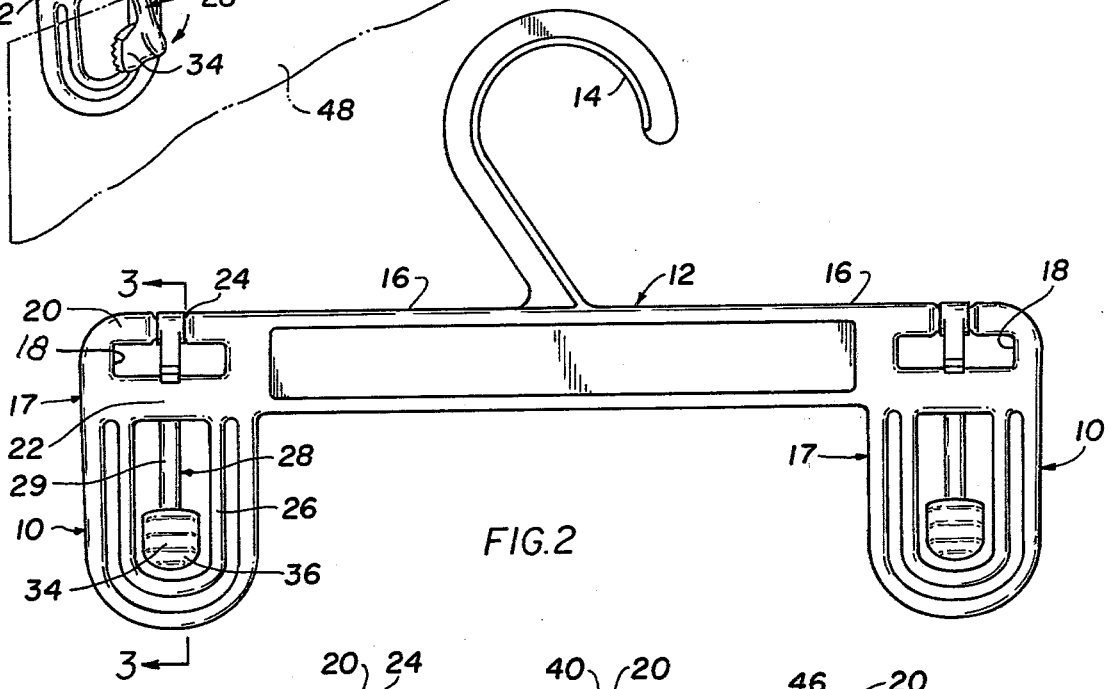
FIG. 2 is a rear elevation view of the clamp of FIG. 1.
Figure 3:
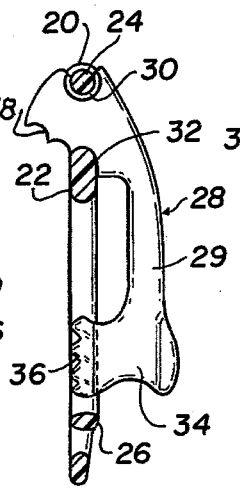
FIG. 3 is a sectional view through one of the clamps of FIG. 2, taken on the line 3—3 of FIG. 2, looking in the direction of the arrows.

Referring to FIGS. 1, 2 and 3, illustrating a first preferred embodiment, the numeral 10 designates the clamp in its entirety, there being a clamp 10 on each end of a clothes hanger 12 comprising a centrally positioned hook 14 and a pair of branches 16 extending laterally and terminating at their outer ends with a clamp 10. The two clamps are identical.

Referring to FIGS. 1 and 2, the clamp 10 comprises a first jaw 17 formed integrally with a branch 16 of the hanger and extending in a downward direction therefrom in order to receive and grip an article of clothing. The upper part of the jaw 17 includes a transversely extending elongated slot 18 adapted to receive the upper end of a second jaw, as will be explained more fully later in this description. The slot 18 is formed by a pair of parallel, spaced, slot forming members 20 and 22, at least one of said members having resilient characteristics, as is found in most plastics, such as Nylon for example. Since the hanger and first jaw 17 are made integral, it is evident that both slot forming members 20 and 22 will have the same resilient characteristics.

The outer or upper slot forming member 20 includes a retaining means in the form of a necked portion 24 of reduced diameter to receive and pivot the upper end of the second jaw 28 as will be described more fully later in this description. The lower end of the jaw 17 includes a resilient article receiving means in the form of a pair of concentric loops supported at their upper ends by the slot forming member 22. It is evident that this construction allows the loops to flex when a pressure is applied thereto. The inner loop 26 includes an opening sufficiently large to permit the head on the lower end of the second jaw 28 to freely pass therethrough as appearing later in this disclosure.

The second jaw 28 comprises an elongated arm 29 also made from any suitable material, preferably of the same material used for the first jaw 17. The upper end of the arm 29 is recessed to provide a pivot means 30 adapted to cooperate with the necked portion or retaining means 24 to form a pivot for the second jaw to permit an oscillating motion of the second jaw. An opposed surface of the upper end of the arm 29 includes an indexing means 38 in the form of a series of corrugations disposed in an arc of a circle having the slot forming member 20 as the center. A stop 32 limits the closing movement of the arm 29 by engaging the side of the member 22 as shown in FIG. 3.

The lower end of the arm 29 carries an inturned article gripping means in the form of a head 34 having a roughened surface 36, the head being so disposed that, when the arm 29 is moved to its closed position, the head freely passes through the loop 26 as illustrated in FIG. 3, in a position to grip and support an article of clothing between the head and the loop as illustrated on the right hand end of FIG. 1.

Figure 5:
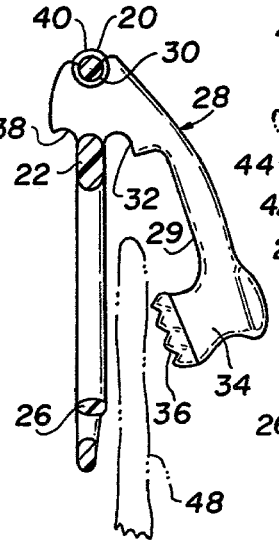
FIG. 5 is a sectional view through FIG. 4, taken on the line 5—5 looking in the direction of the arrows.
Figure 6:
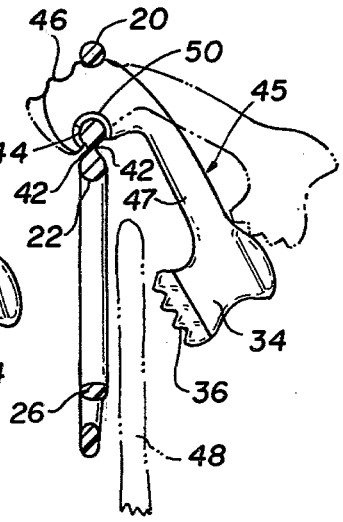
FIG. 6 is a sectional view, similar to FIG. 5, illustrating a modified form of pivot means for one of the jaws.

To assemble the two jaws, the upper end of the second jaw 28 having the pivot means 30 and the indexing means 38 is inserted within the slot 18 with the longitudinal axis of the arm 29 of the jaw parallel with the slot. The arm is rotated until the pivot means 30 engage the retaining means 24 and the indexing means 38 engage the slot forming member 22. Continued rotation of the arm 29 will spread apart the slot forming members 20 and 22, until the longitudinal axis of the arm is in the position shown in the drawings, in which the resilient force of the members 20 and 22 retains the arm in position, and the retaining means 24 prevent lateral movement. When in a closed position as shown in FIG. 3, the jaw 28 can be opened either by grasping the lower end between the thumb and a finger and pulling, or by pressing on the head 34 from the left by a thumb or finger, or if an article of clothing is being gripped by the head, the jaw may be opened by pressing against the article from the left of FIG. 3. The arm is capable of occupying any of three positions according to the valleys or dwells of the serrated indexing means 38. Obviously more or fewer positions can be provided. FIGS. 5 and 6 illustrate intermediate open positions, in which a garment or other article of clothing can be inserted, and the jaw closed as described above. Since the head 34 passes through the loop 26, the article being gripped is never pressed between the jaws but held by the spaced head 34 and the loop 26. The roughened surface 36 on the head provides a frictional surface preventing the article being gripped from sliding between the jaws. The resilient force of the loop 26, as it is bent backward, forces the article against the head, and any reaction on the head 34 tending to cause a counterclockwise movement of the arm 29 will cause the slot forming member 22 to ride up toward a peak of the indexing means 38 producing a counter resilient force which tends to produce rotation of the arm 29 in a clockwise direction, whereby the article of clothing 36 is gripped by two opposing resilient forces.

Figure 4:
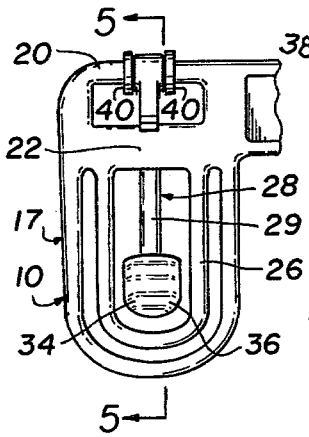
FIG. 4 is a rear elevation of a modified form of the retaining means for the hinged end of one of the jaws.

FIGS. 4 and 5 illustrate a modification of the retaining means, utilizing a pair of flanges 40, one on each side of the pivot means 30.

FIG. 6 illustrates a second preferred embodiment of the invention, in which the positions of the pivot means and the indexing means are reversed. In this embodiment, the second jaw 45 comprises an elongated arm 47 having a head 34 on the lower end, and pivot means 44 on the other end. Instead of having the pivot means disposed on the outer surface of the arm as in the previously described embodiment, the pivot means 44 are disposed on the inner surface and engage the inner slot forming member 22 which is provided with a retaining means in the form of a pair of spaced retaining flanges 50, one on each side of the pivot means. The slot forming member 22 has indentations 42 on both sides to permit oscillations of the arm 47 from a fully opened position to a fully closed position. Corrugations 46, forming an indexing means, are disposed on the outer surface and arranged in the arc of a circle about the pivot means 44 as a center, and cooperate with the slot forming member 20 to give a step-by-step movement to the arm 29 from its fully open position to its fully closed position. All of the other parts of the clamp in this embodiment of the invention are the same as those in the first preferred embodiment, and cooperate in the same manner.

It may therefore be understood, from the several embodiments of the invention shown in the drawings and described in detail above, that I have invented a practical and economical clamp, that will securely grip and support articles of clothing as well as other flexible and rigid articles, which has a long and useful life, can be easily and quickly operated, and permits the accidental withdrawal of gripped articles without danger of injury to the articles.

It should be understood that the invention is not confined to the particular forms shown and described, the same being merely for purposes of illustration of the broad concept of the invention, and that the invention may be carried out by other devices within the scope of the subjoined claims without departing from the spirit of the invention.

I claim:

1. A clamp adapted to grip articles, comprising: a first jaw and a second jaw; said first jaw having, adjacent one end thereof, a slot and the other end having resilient article receiving means; said second jaw comprising an elongated arm having, on one end, means engaging one side of said slot providing a pivot means for said arm and indexing means engaging an opposite side of said slot from a fully opened position to a closed gripping position, said indexing means comprising a series of corrugations disposed in an arc of a circle about said pivot means to provide a resilient step-by-step motion to said pivoted arm; and means on the other end of said arm, cooperating with said resilient article receiving means, to grip an article between them.

2. A clamp as defined in claim 1, in which said slot is formed by spaced inner and outer, transversely extending, members, at least one of said members having resilient characteristics.

3. A clamp as defined in claim 2, in which the outer of said members is resilient, and in which the pivot means is provided by the engagement of said arm with said outer of said members, and said indexing means engages the inner of said members.

4. A clamp as defined in claim 2, in which the outer of said members is resilient, and in which the pivot means is provided by the engagement of said arm with the inner of said members, and said indexing means engages the outer of said members.

5. A clamp as defined in claim 2, including retaining means carried by the member that is engaged by said pivot means on said arm, limiting the lateral movement of said arm.

6. A clamp as defined in claim 5, in which said retaining means comprises a pair of flanges, one on each side of said pivot means on said arm.

7. A clamp as defined in claim 5, in which said member includes a portion of reduced thickness, said pivot means on said arm engaging said portion.

8. A clamp as defined in claim 1, in which the said resilient means on the other end of said first jaw includes an elongated member supported at one end.

9. A clamp as defined in claim 8, in which said resilient means is in the form of a loop including an opening therein, and in which said other end of said arm is mounted to pass through said opening when in closed position.

10. A clamp as defined in claim 9, in which said opening in said loop is larger than the said other end of said arm, whereby said other end may freely pass through said opening without contacting the sides of said opening.

* * * * *